United States Patent [19]

Russo

[11] 3,949,836

[45] Apr. 13, 1976

[54] LADDER STRUCTURE

[75] Inventor: Adolph D. Russo, Beachwood, Ohio

[73] Assignee: Russo Ornamental Iron Products, Inc., Bedford Heights, Ohio

[22] Filed: Nov. 8, 1974

[21] Appl. No.: 522,150

[52] U.S. Cl. ..... 182/194; 182/228; 182/46

[51] Int. Cl.[2] ..... E06C 7/50

[58] Field of Search ..... 182/228, 194, 46; 403/297, 403/248, 249, 250, 251, 243; 85/84, 72, 83; 52/720, 710

[56] References Cited

UNITED STATES PATENTS

| | | | |
|---|---|---|---|
| 1,191,151 | 7/1916 | Brush | 85/83 |
| 2,006,300 | 6/1935 | Kinninger | 52/710 |
| 2,989,141 | 6/1961 | Howard | 182/228 |
| 3,186,561 | 6/1965 | Strassle | 52/738 |
| 3,469,493 | 9/1969 | Fisher | 85/72 |
| 3,520,663 | 7/1970 | Schertel | 52/738 |
| 3,566,992 | 3/1971 | Berger | 182/228 |
| 3,608,256 | 9/1971 | Jefferys | 182/228 |

FOREIGN PATENTS OR APPLICATIONS

| | | | |
|---|---|---|---|
| 657,746 | 9/1951 | United Kingdom | 182/228 |
| 1,501,748 | 10/1967 | France | 182/228 |

OTHER PUBLICATIONS

Designing With Aluminum Extrusion, Reynolds Metals Co.

*Primary Examiner*—Reinaldo P. Machado
*Attorney, Agent, or Firm*—Meyer, Tilberry & Body

[57] ABSTRACT

Ladder structures are disclosed comprising a pair of side rails and a plurality of tubular extruded aluminum rung members extending therebetween. The opposite ends of each rung are interconnected with the corresponding side rail by means of an expandable fastener extending through an opening in the rails and into the rung end. The openings in the rails and rung are non-circular and the corresponding portions of the fastener are non-circular, whereby rotation of the fastener and rung relative to the side rail is precluded.

23 Claims, 8 Drawing Figures

32
B
30
28
26
30
30
32
30
34
A
10
12
16
14
18
20
22
16
24
12
14
52
40
38
36
C
44
40
52
42
46
50
66
E
68
56
58
70
60
64
62
56
60
58
62
64
54
D

LADDER STRUCTURE

The present invention relates to the art of ladders and, more particularly, to improved ladder structures.

Numerous efforts have been made heretofore to provide ladders which are light in weight so as to increase the portability and ease of handling thereof by reducing the overall weight relative to ladders of the same size made from heavy metal or wood. The desired lightness in weight can be obtained by the use of light weight metal such as aluminum for the component parts. However, such ladders are expensive to construct and, often, require special tooling and machining to achieve assembly of the components thereof and a desired structural integrity. Moreover, the joints between the rails and rungs of such ladders often become loose during use whereby the rung can rotate relative to the rails. This, of course, presents a potentially dangerous situation for a user of the ladder. Further, ladder maintenance, such as the replacement of a worn or damaged rung member, is often impossible or requires special tooling. Accordingly, part replacement is often impractical and, if possible, is time consuming and costly.

In accordance with the present invention, an improved ladder structure is provided which overcomes the foregoing disadvantages and others of previous ladder structures. In this respect, a ladder in accordance with the present invention is comprised of side rails and rung members interengaged by expandable fasteners, each of which extends through an opening in a side rail and into an opening extending axially into the corresponding end of the rung member. The openings in the side rail and rung are non-circular and the fastener has non-circular portions within the rail and rung openings. This relationship advantageously precludes rotative displacement of the rung relative to the rails. Radial expansion of the portion of the fastener in the rung restrains axial separation of the rung from the side rail.

In accordance with one embodiment of the invention, the side rail is an extruded aluminum U-shaped channel, and the rung is an extruded aluminum member having concentric inner and outer tubular portions interconnected by webs extending radially of the rung axis. At least the opening through the inner tubular portion is non-circular in cross section, and the web of the rail channel has an opening of non-circular contour. The fastener has a non-circular portion disposed in the rail opening and a non-circular portion disposed in the inner tube of the rung, and the latter portion of the fastener is radially expandable by means of a pin adapted to be driven axially into the fastener body. The rung and rail are readily interengaged by aligning the opening in the rail with the inner tube of the rung, introducing the fastener through the rail opening and into the rung tube, and then driving the rod or pin axially into the fastener body to radially expand the portion disposed in the rung into tight frictional engagement therewith. Further, the rung and side rail connection can be readily disassembled by driving the pin completely through the fastener body thereby releasing the radially expanded portion for separation from the rung. Preferably, a cover plate is removably associated with each channel to add rigidity to the side rails, protect the exposed ends of the fasteners, and provide an overall pleasing appearance to the ladder. Further, end plates preferably are provided across the opposite ends of the side rails to protect the rail ends during use.

In accordance with another embodiment of the invention, the side rails include channel-shaped members of non-metallic material, preferably fiber glass. The web of each channel is provided with an aperture corresponding to the end of a given rung, and metal plate members are provided on opposite sides of the channel and have intermediate portions disposed in and/or across the aperture. The intermediate portions are provided with a non-circular opening aligned with the non-circular opening in the rung end, and the expandable fastener has non-circular portions disposed in the rung opening and the opening through the plate members. At least one of the plate members is restrained against rotating relative to the channel member about the axis of the non-circular openings, and the non-circular portion of the fastener disposed in the rung opening is radially expandable by means of a pin adapted to be driven axially into the fastener body. The rung and side rails are readily interengaged by positioning the plate members on the opposite sides of the channel web, aligning the opening in the rung with the opening through the plate members, introducing the fastener through the openings, and then driving the pin axially into the fastener body to radially expand the portion thereof disposed in the rung. Again, the rung and side rails can readily be disassembled in the manner described hereinbefore.

It is accordingly an outstanding object of the present invention to provide an improved ladder structure.

A further object is the provision of a ladder structure in which a rung and side rail are interengaged by an expandable fastener assembly cooperable therewith to positively restrain rotation of the rung relative to the side rail.

Yet a further object is the provision of a ladder structure in which the number of component parts and the assembly time is minimized for a given number of rung members.

Another object is the provision of a ladder structure of the foregoing character in which the fastener assembly, rung and side rail components can be readily disassembled and reassembled with a minimum expenditure of time and effort, thus to facilitate and minimize the cost of maintenance of the ladder.

Still another object is the provision of a ladder structure of the foregoing character comprised of parts which enable the ladder components to be readily assembled and disassembled, to restrain rung rotation relative to the side rails, and to provide structural integrity against relative deflection and/or separation of the component parts during use.

The foregoing objects, and others, will in part be obvious and in part pointed out more fully hereinafter in conjunction with the written description of preferred embodiments of the invention illustrated in the accompanying drawings in which.

Figure 1:
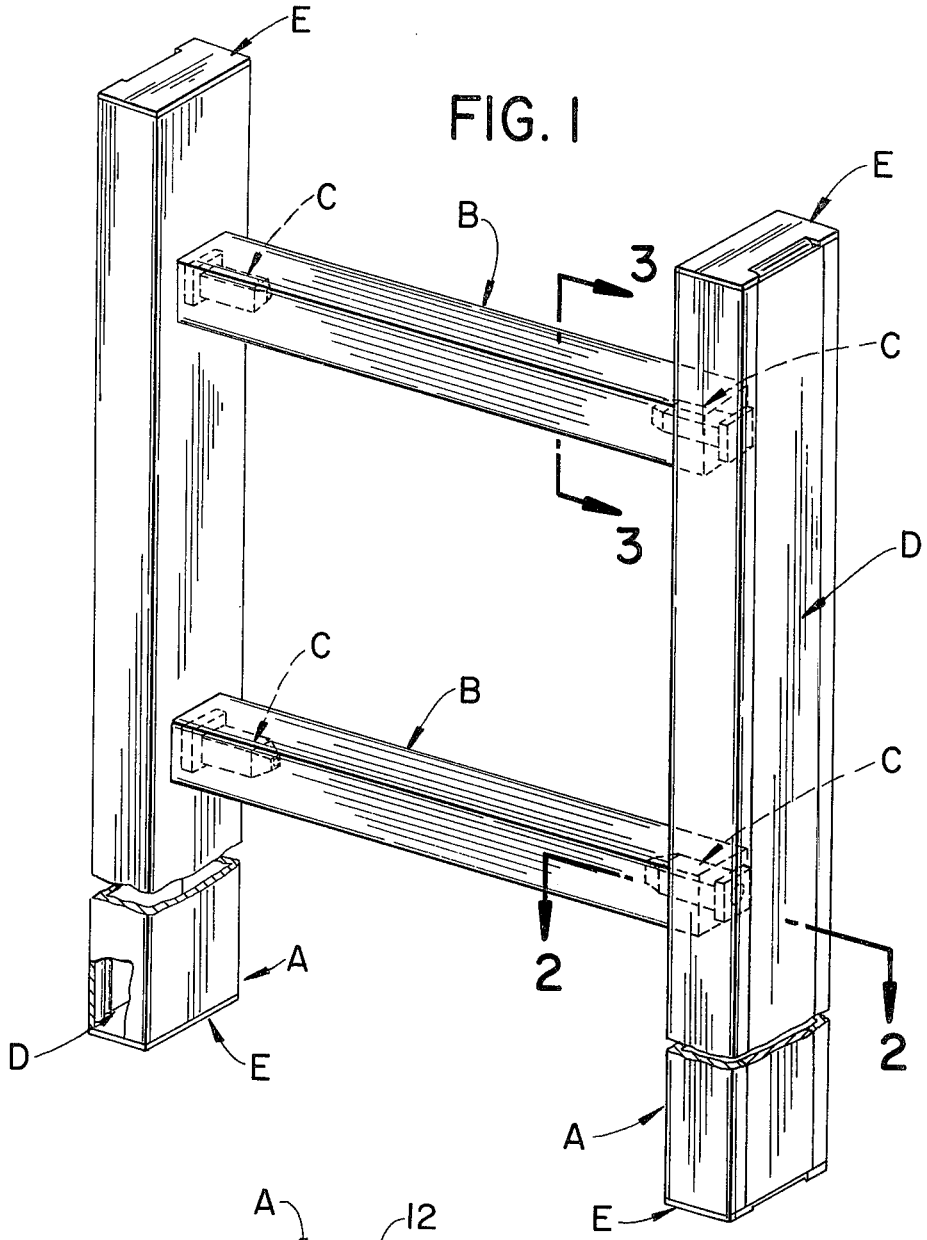
FIG. 1 is a perspective view of a ladder made in accordance with the present invention.

Referring now in greater detail to the drawings wherein the showings are for the purposes of illustrating preferred embodiments of the invention only and not for the purpose of limiting the invention, a ladder structure is illustrated in FIG. 1 which includes a pair of elongated side rails A laterally spaced apart and interconnected by a plurality of rungs B. The opposite end of each rung B is interconnected with the corresponding rail by an expandable fastener assembly C. Side rails A are channel-shaped in cross section, opening outwardly with respect to the rungs, and cover plates D interengage with the rails to close the open side thereof. Preferably, the opposite ends of the tubular structure defined by rails A and cover plates D are closed by end plates E.

Figure 2:
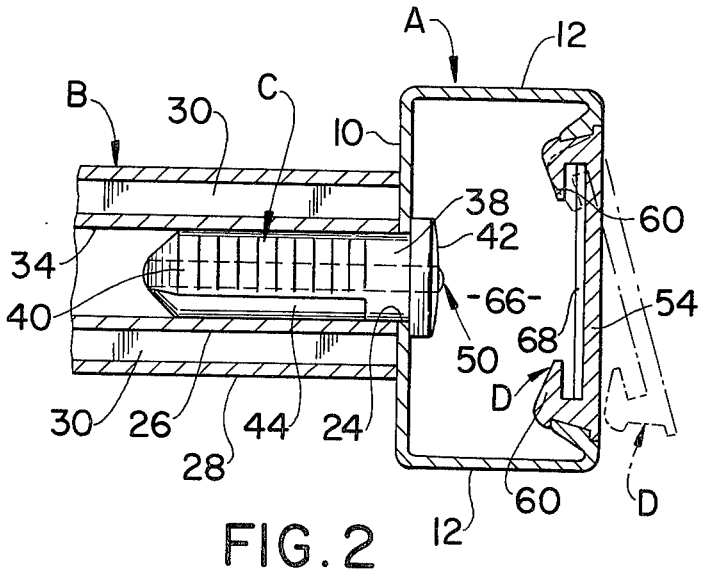
FIG. 2 is a cross-sectional view taken along line 2—2 in FIG. 1.
Figure 3:
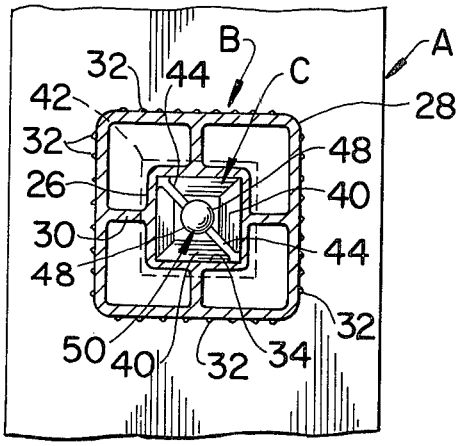
FIG. 3 is a cross-sectional view taken along line 3—3 in FIG. 1.
Figure 4:
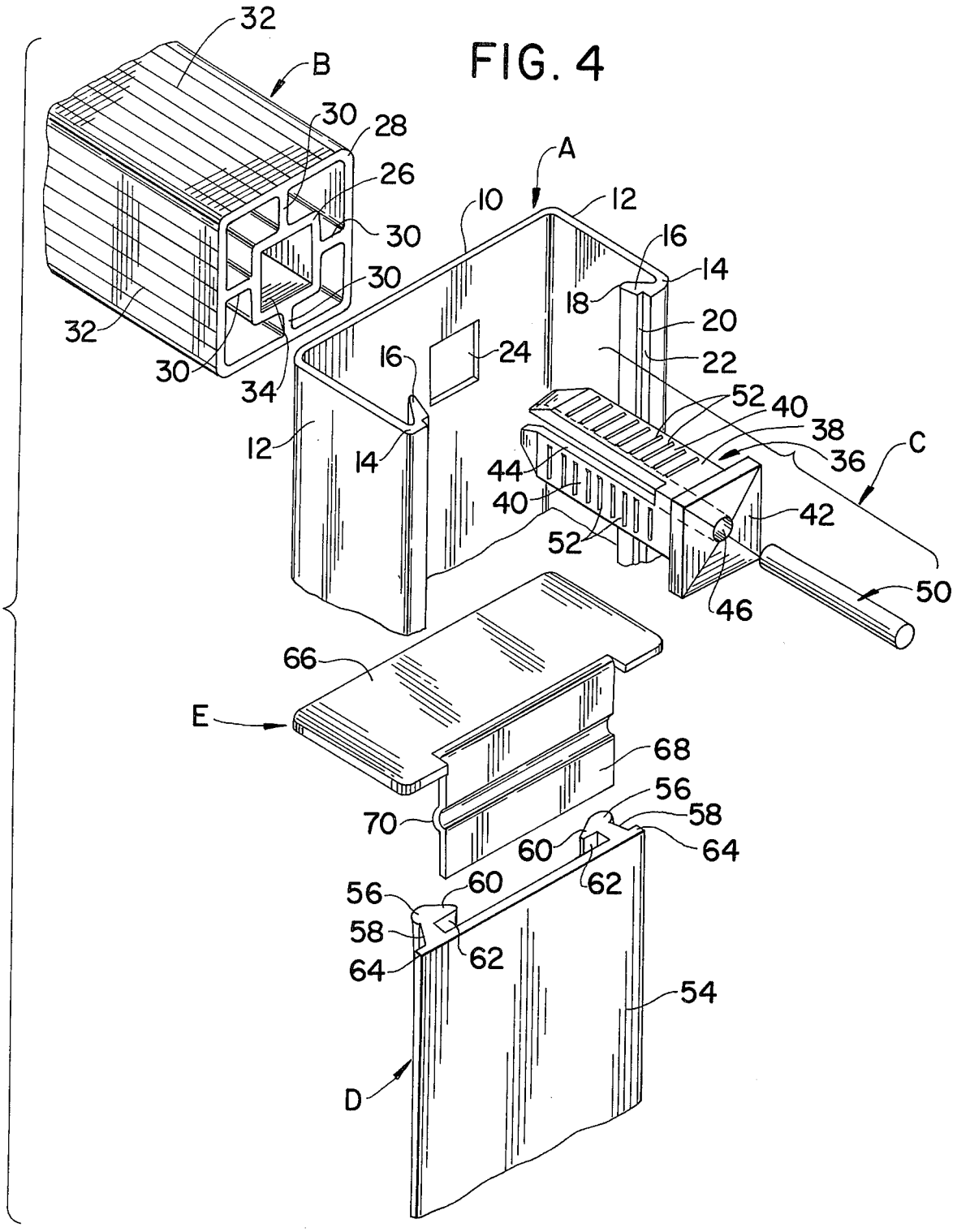
FIG. 4 is an exploded view of the component parts of the latter structure shown in FIGS. 1–3.
Figure 5:
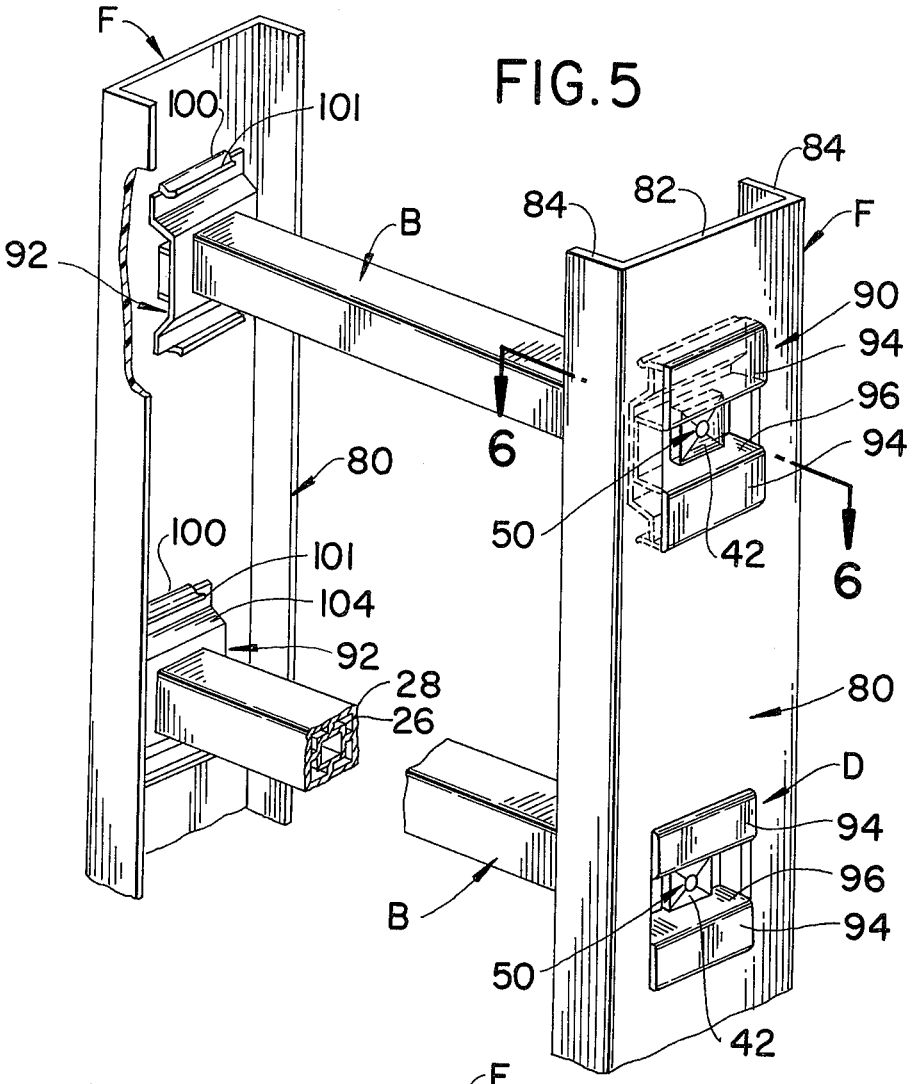
FIG. 5 is a perspective view of another ladder made in accordance with the present invention.
Figure 8:
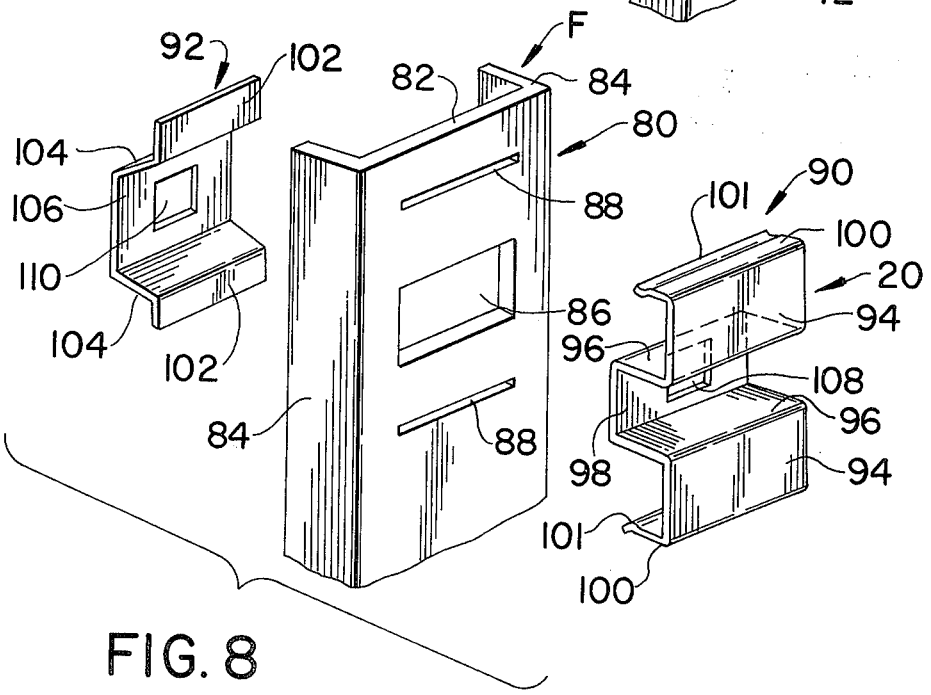
FIG. 8 is an exploded view of component parts of the ladder shown in FIGS. 5–7.

The preferred structures of the ladder components described above, and the structural interrelationship therebetween, are shown in FIGS. 2–4 of the drawing. In this respect, each of the side rails A is an elongated extruded aluminum member which includes a web 10 and a pair of flanges 12 generally perpendicular to the web and extending along the opposite side edges thereof. Each flange 12 has a terminal edge portion 14 including a leg 16 extending downwardly and inwardly with respect to web 10 and at an angle to the corresponding flange 12. Leg 16 has an inner edge 18 spaced from web 10, and the outer end of leg 16 is provided with a recess including a bottom wall 20 generally parallel to web 10 and an outer wall 22 extending outwardly from wall 20. The area of leg 16 between edge 18 thereof and recess wall 20 defines a projection for the purpose set forth hereinafter.

Web 10 of rail member A is provided along its length with a plurality of non-circular openings 24, one for each rung member of the ladder structure, and the axis of opening 24 preferably is disposed centrally with respect to the side edges of the web. In the embodiment shown, openings 24 are generally square and accordingly have opposed pairs of parallel spaced apart sides with respect to the axis of the openings. While square openings are preferred, non-circular openings other than a square opening can be employed.

Each rung member B is an extruded aluminum component having concentric inner and outer tubular portions 26 and 28, respectively, interconnected by radially extending webs 30. In the embodiment shown, tubular portions 26 and 28 are generally square in cross section and having corresponding generally parallel sidewalls providing for each of the tubular portions to be peripherally closed. Webs 30 extend radially between the inner and outer tubular portions and between locations disposed generally centrally between the longitudinal edges of the corresponding parallel walls. The outer surface of outer tubular portion 28 is provided with longitudinally extending tread defining ribs 32. Inner tubular portion 26 defines a generally square opening 34 extending axially inwardly of the end of the rung and corresponding in radial dimension with opening 24.

Expandable fastener assemblies C include a plug component 36, preferably of cast aluminum having a non-circular portion 38 received in opening 24 of rail A, and a non-circular portion defined by a pair of legs 40 extending axially from portion 38. Legs 40 are received in inner tubular portion 26 of rung B. The outer end of non-circular portion 38 is provided with an integral flange 42 which engages web 10 about the periphery of opening 24 to limit insertion of plug 36.

In the embodiment shown, non-circular portion 38 of the fastener is generally square and interengages with the side edges of opening 24 to prevent rotation of the plug relative to rail A. Likewise, the cross-sectional configuration of legs 40 together is generally square so that the legs engage the inner surfaces of opening 34 in rung B to prevent rotation of the rung relative to the fastener and thus rail A. Each of the legs 40 is generally triangular in cross section, and the inner faces 44 of the legs are generally parallel and spaced apart in a direction diagonal to opening 34. Plug 36 is provided with an axially extending circular passageway 46 opening from flange 42 to the axially inner end of the space between legs 40. Inner faces 44 of legs 40 are provided with arcuate recesses 48 aligned with passageway 46.

Fastener assemblies C further include a pin component 50 such as a circular steel pin having a diameter which provides for the pin to be tightly received in passageway 46 against unintentional displacement therefrom. The spacing between legs 40, at least at some point along the length thereof, is less than the diameter of pin 50. Pin 50 is adapted to be driven axially into passageway 46, such as by a hammer. Accordingly, upon displacement of pin 50 axially through passageway 46 into the space between legs 40, the legs are radially displaced for the outer surfaces thereof to tightly engage the corresponding inner surfaces of rung opening 34. Preferably, the outer surfaces of legs 40 are provided with transversely extending ribs 52 which project upwardly from the corresponding surface. Ribs 52 are longitudinally narrow and have relatively sharp outer edges. Accordingly, the ribs bite into the metal of inner tubular member 26 of the rung upon radial expansion of the legs to restrain axial separation of plug 36 from rung B.

Cover D preferably is an extruded aluminum conponent including a generally flat plate portion 54 having a width corresponding to the lateral space between recess sidewalls 22 of rail flanges 12. Further, plate portion 54 has a thickness generally corresponding to the height of recess wall 22. The inner surface of plate portion 54 is provided adjacent the side edges thereof with projections 56 having recesses 58 in the outer sides thereof. Recesses 58 open laterally outwardly to receive the projections on legs 16 of rail flanges 12, as shown in FIG. 2. Projections 56 further include leg portions 60 spaced from and generally parallel to the inner surface of plate 54, whereby legs 60 and the inner surface of plate 54 define inwardly open opposed recesses 62 extending longitudinally of cover plate D for the purpose set forth hereinafter.

The projections on legs 16 of rail flanges 12, and recesses 58 on cover plate D provide for the rail and cover plate to be snap-locked together by first positioning the cover plate component in the position indicated by broken lines in FIG. 2 and then pivoting cover plate D to the solid line position thereof. During the latter movement, the innermost end of projection 56 on the cover plate engages the projection on leg 16 of the rail flange and cams the flange laterally to allow the flange projection to pass the inner end of cover projection 56 and enter recess 58. When fully seated, side edges 64 seat in the recess defined by walls 20 and 22 on terminal portions 14 of the rail flanges.

End plate E is preferably produced from steel and includes a generally flat plate portion 66 having a peripheral contour generally corresponding to the outer periphery of the assembled rail channel and cover plate components. In the embodiment disclosed, plate 66 has an integral flange 68 extending from one side edge thereof and generally perpendicular thereto. The side edges of flange 68 are adapted to be received in a corresponding one of the opposed recesses 62 of cover plate D. Further, flange 68 is provided with a detent 70 extending across the flange and transverse to the direction of insertion thereof into recess 62. The detent provides for the side edges of flange 68 to be tightly engaged in recesses 62 against unintentional separation of the end plate from the cover plate.

From the foregoing description, it will be appreciated that the ladder is readily constructed by aligning the non-circular rung and rail openings, inserting a fastener assembly C into the openings, and driving pin 50 axially inwardly of the rung to radially expand the leg portions of the plug. Once the desired number of rungs have been so assembled with the rail members, cover plates D are snapped in place to close the rail channel, and end plates E are driven into the opposite end of the cover plate. The ladder could, of course, be constructed without cover plates D and end plates E, but the covers advantageously strengthen the rails against twisting and lateral flexure, and the end plates protect the ladder ends from damage and wear during use. Should it be necessary to disassemble a fastener assembly to achieve replacement thereof or replacement of a rung member, such removal is achieved by driving pin 50 axially inwardly of the rung until the pin is free of legs 40 of plug 36. This frees legs 40 for radial displacement of inner faces 44 toward one another so that the plug can be withdrawn from the rung.

In the ladder structure described above, the rail members are extruded metal components. The present invention, however, advantageously enables the construction of a ladder in which the rail members are defined by components of light weight non-metallic material, such as fiber glass. A preferred embodiment of such a ladder structure is illustrated in FIGS. 5–8 of the drawing.

The ladder structure shown in FIGS. 5–8 includes rung components and expandable fastener assemblies structurally corresponding to rungs B and fastener assemblies C described hereinabove in connection with the showings of FIGS. 1–4. Accordingly, like numerals are employed in FIGS. 5–8 with regard to the rung and fastener assembly components illustrated in FIGS. 1–4. As will be seen in FIGS. 5–8, the ladder structure includes a pair of side rails F and a plurality of rungs B extending therebetween and interconnected therewith by fastener assemblies C. Each of the side rails F includes a channel-shaped fiber glass member 80 having a web 82 and flanges 84 along the side edges thereof and extending in the direction toward the corresponding ends of rungs B. Webs 82 of the channels define opposed walls for the side rails, and rectangular apertures 86 are provided in the webs for each of the rungs B. It will be appreciated that apertures 86 for a given rung are in alignment with one another. Webs 82 are further provided with a pair of slots 88 spaced from the parallel to the upper and lower edges of aperture 86, for the purpose set forth hereinafter.

Each side rail F further includes plate members 90 and 92, preferably of extruded aluminum, associated with each aperture 86 and on opposite sides of web 82. Plate member 90 includes opposite end portions 94 and an intermediate portion therebetween defined by legs 96 and a bridging portion 98 therebetween. Each leg 96 is perpendicular to the corresponding end portion 94 and bridging portion 98 is perpendicular to the legs. The outermost ends of end portions 94 are bent in the direction of legs 96 and parallel thereto to define fingers 100. When assembled with the corresponding channel member 80, legs 96 extend through aperture 86 adjacent the upper and lower edges thereof, and fingers 100 extend through the corresponding slot 88 in web 82. Preferably, legs 96 are of a length axially of aperture 86 greater than the thickness of web 82, whereby plate portion 98 is axially spaced from the inner surface of web 82. Further, fingers 100 preferably extend through slots 88 and beyond the inner surface of web 82 and terminate in arcuate detents 101 which serve the purpose set forth hereinafter. Further, plate member 90 preferably has a width in the direction between flanges 84 of member 80 corresponding to the length of the upper and lower edges of aperture 86, and fingers 100 and slots 88 have corresponding widths in the direction between flanges 84.

Figure 6:
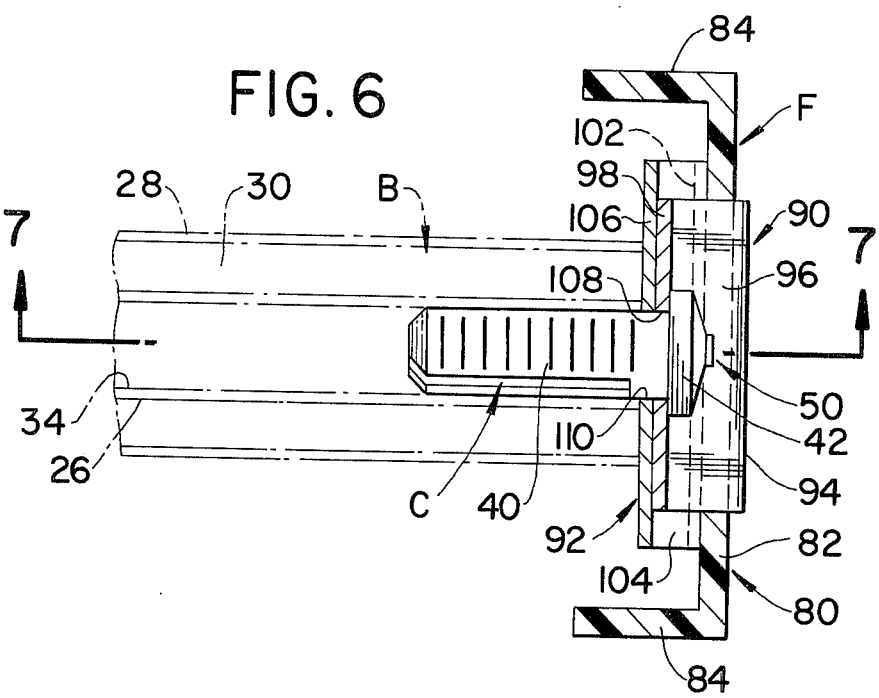
FIG. 6 is a cross-sectional view taken along line 6—6 in FIG. 5.
Figure 7:
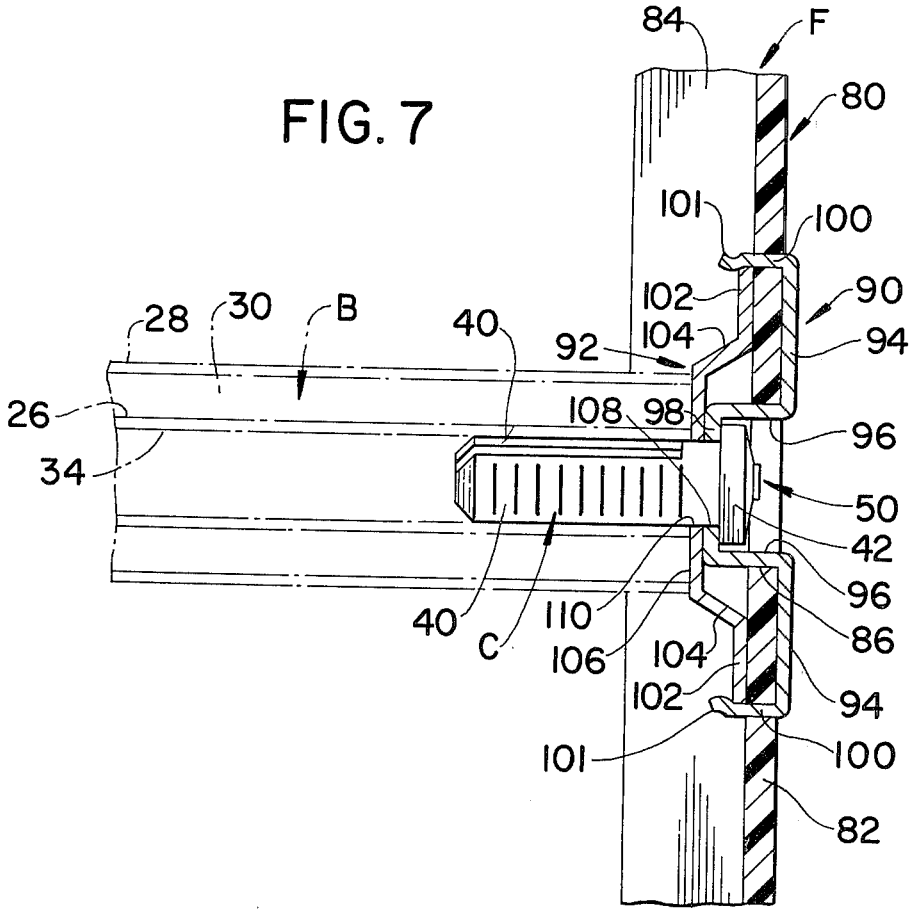
FIG. 7 is a cross-sectional view taken along line 7—7 in FIG. 6.

Plate member 92 includes opposite end portions 102 overlying the inner surface of web 82, and an intermediate portion including legs 104 extending axially inwardly from ends 102 and a bridging plate portion 106 between legs 104. When plate member 92 is in the assembled position thereof, as best seen in FIGS. 6 and 7, the outer edges of end portions 102 are juxtaposed with respect to the inner surfaces of fingers 100 of plate number 90 behind detents 101 thereon, and intermediate portion 106 is disposed in overlying engagement with bridging portion 98 of plate member 90. Detents 101 are spaced apart a distance less than that between the outermost edges of end portions 102, whereby plate members 90 and 92 are adapted to be snap-locked together when mounted on the side rail. Fingers 100 advantageously restrain rotation of plate member 90 relative to web 82 about the axis of aperture 86 and, in the preferred embodiment, the structural and dimensional interrelationship between legs 96 of plate member 90 and the sides of apertures 86 further restrain such rotation. Further, the juxtaposed relationship between the outermost edges of end portion 102 of plate member 92 and the inner surfaces of fingers 100 of plate member 90 advantageously position plate member 92 relative to plate member 90 and restrain rotational displacement of plate member 92 relative to plate member 90 and web 82.

Bridging plate portions 98 and 106 of the plate members are provided with square openings 108 and 110, respectively, which are in alignment with one another to define a non-circular opening aligned with the opening defined by inner member 26 of rung B. Accordingly, the rung and side rail assemblies are interengaged by introducing fastener C through openings 108 and 110 and into the rung tube 26 until retaining flange 42 of the fastener engages bridging plate portion 98 of palte member 90. Pin 50 is then driven axially into the fastener body to radially displace legs 40 of the fastener into engagement with the inner surface of tube 26. Plate members 90 and 92 thus clampingly engage the corresponding portion of rail web 82 therebetween.

It will be appreciated from the foregoing description of the embodiment shown in FIGS. 5–8, that plate members 90 and 92 strengthen non-metallic channel member 80 against fluxure during use of the ladder and minimize wear and damage of the non-metallic material of the channel which would result during use of the ladder from direct engagement of the rung ends and fastener retaining flanges therewith. While an assembly of two plate members structured as shown and herein described is preferred, it will be appreciated that the desired structural integrity at the rung joint can be achieved with a single plate member such as plate member 90 suitably interengaged with the channel member against separation therefrom axially of aperture 86, or with plate member assemblies structured other than the preferred assembly shown. The preferred plate assembly structure advantageously provides for the outer ends of fastener C to be recessed with respect to the outer sides of the channel members, thus to avoid exposure of the fasteners and injury to the user of the ladder which could result from such exposure. Further, while a channel-shaped rail member is shown, it will be appreciated that the non-metallic side member can be provided with any desired cross-sectional shape. For example, a side member of I-beam cross section could readily be employed. Moreover, as described hereinabove in connection with the embodiment shown in FIGS. 1–4, the rung and side rail connection can quickly be disassembled by displacing pin 50 of the fastener assembly axially inwardly of the rung until the pin is free of legs 40 of the fastener plug. Accordingly, the advantages of quick assembly and disassembly and retention of the rung against rotation relative to the rails are also achieved with the embodiment of FIGS. 5–8.

While considerable emphasis has been placed herein on the specific structure and the structural interrelationship between the components of the ladders shown, it will be appreciated that many modifications of the preferred arrangements can be made without departing from the principles of the present invention. In this respect, for example, it is only necessary that the openings in the side rail and rung and the corresponding portions of the fastener plug received therein be of a cooperable non-circular contour to prevent relative rotation therebetween. Many contours providing the latter relationship will be readily apparent. Moreover, it will be apparent that the openings in the rung and side rails do not have to be of the same size or contour. Further, axial positioning of the fastener plug against displacement through the side rail opening and into the rung opening can be achieved other than by a flange integral with the plug.

With regard to the rung, it is only necessary that the opening therein for receiving the fastener be of non-circular contour and, accordingly, in a concentric tubular structure, as shown, the outer tubular portion could be of any desired cross-sectional contour including circular. Further, the inner and outer rung members do not have to be concentric, the outer member does not have to be tubular, and the non-circular rung opening can be defined other then by a peripherally closed inner tubular member.

With regard to the expansible fastener, it will be appreciated that fastener assemblies other than the specific assembly shown can be employed, it only being necessary to provide for the fastener portions received in the side rail and rung openings to be of non-circular contour so as to interengage the rung and rail against relative rotation. Moreover, while the spreadable leg and cylindrical driven pin structure is preferred, it will be apparent that the desired fastener expansion can be achieved by many other fastener structures.

As many possible embodiments of the present invention may be made, and as many possible changes may be made in the embodiments herein illustrated and described, it is to be distinctly understood that the foregoing descriptive matter is to be interpreted merely as illustrative of the present invention and not as a limitation.

What is claimed is:

1. A ladder comprising, spaced apart rail members and a plurality of rungs extending therebetween, said rail members having corresponding inner and outer surfaces, each rung having opposite ends facing the inner surface of a corresponding one of said rail members, each of said opposite ends having a non-circular opening extending axially inwardly of said rung, each of said rail members having a non-circular opening therethrough axially aligned with the opening in the corresponding end of said rung, and expandable fastener means interconnecting each of said opposite ends of said rung with the corresponding rail member, said fastener means including first and second non-circular portions respectively in said rung opening and said rail member opening and of complementary non-circular configuration and dimension with respect to the corresponding opening so as to interengage therewith to prevent rotation of said fastener means and rung relative to said corresponding rail member, said first portion including radially displacable legs in said rung opening, and said fastener means further including means engaging the outer surface of the corresponding rail member to position said first and second portions axially of said openings and a member displacable relative to said legs to radially spread and wedge said legs of said first portion against the inner surface of said rung opening.

2. The ladder according to claim 1, wherein each of said rail members includes a channel-shaped member having a web and a pair of flanges, said rail member opening being in said web, said flanges extending from said web in the direction axially away from said rung, and a cover plate extending between said flanges and removably interengaged with said member.

3. The ladder according to claim 2, wherein said rail member and cover plate have corresponding opposite ends, and end plate means extending across said opposite ends.

4. The ladder according to claim 3, wherein said cover plate includes recess means extending longitudinally with respect thereto, and said end plate means includes flange means received in and frictionally interengaging said recess means.

5. The ladder according to claim 1, wherein said rung is a tubular metal extrusion including radially spaced concentric inner and outer members and radially extending webs interconnecting said inner and outer members, said inner member including wall means providing said non-circular rung openings.

6. The ladder according to claim 5, wherein said wall means includes two opposed pairs of parallel walls, said walls each having axially extending edges, and said radially extending webs including a web extending from each wall at a location intermediate said edges thereof.

7. The ladder according to claim 1, wherein said rung and rail member openings are generally square, said first and second non-circular portions of said fastener means are generally square, and said first and second non-circular portions and said rung and rail member openings are of substantially the same dimensions in cross section.

8. The ladder according to claim 7, wherein each said rail member includes a channel member having a web and a pair of flanges, said flanges extending from said web in the direction axially away from said rung, said rail member opening being through said web, and a cover plate spaced from said web and releaseably interengaged with said channel flanges.

9. The ladder according to claim 8, wherein said rung is a tubular metal extrusion including radially spaced concentric inner and outer members and radially extending webs interconnecting said inner and outer members, said inner member including wall means providing said non-circular rung openings.

10. The ladder according to claim 9, wherein said channel member and cover plate have corresponding opposite ends, and an end plate interconnected with said cover plate and extending across at least one of said opposite ends.

11. A ladder comprising, spaced apart rail means and a plurality of rungs extending therebetween, each rung having opposite ends facing a corresponding one of said rail means, each of said opposite ends having a non-circular opening extending axially inwardly of said rung, each of said rail means having a non-circular opening axially aligned with the opening in the corresponding end of said rung, expandable fastener means interconnecting each of said opposite ends of said rung with the corresponding rail means, said fastener means including first and second non-circular portions respectively in said rung opening and said rail means opening and interengageable with the corresponding opening to prevent rotation of said fastener means and rung relative to said corresponding rail means, said rung being a tubular metal extrusion including radially spaced concentric inner and outer members and radially extending webs interconnecting said inner and outer members, said inner member including wall means providing said non-circular rung openings, each said rail means including a non-metallic member having a wall, said wall having an aperture therethrough corresponding to each of said rungs, plate means on said wall at said aperture, said plate means having an outer portion overlying the wall radially outwardly of said aperture and an inner portion radially inwardly of said outer portion, said non-circular opening through said rail means being through said inner portion of said plate means, means interengaging said plate means with said wall against rotation relative thereto, said means interengaging said plate means with said wall including finger means on the outer portion of said plate means and extending toward said wall, and finger receiving opening means in said wall receiving said finger means, said aperture through said wall being rectangular, said plate means including first and second plate members having inner and outer portions, said outer portions engaging the opposite sides of said wall, and the inner portion of said first plate member extending through said aperture and engaging the edges of said aperture to further interengage said plate means against rotation relative to said wall.

12. A ladder comprising, a pair of spaced apart metal rails and a plurality of rungs extending therebetween, said rails being channel members having web and a pair of flanges extending from said web and axially outwardly with respect to said rungs, each of said rungs having opposite ends and being an extruded tubular metal member having concentrically interconnected inner and outer tubes, said inner tube having a polygonal opening therethrough between said opposite ends, said opposite ends of said rung engaging the web of a corresponding one of said rails, the web of each rail having a polygonal opening therethrough axially aligned with said polygonal opening through said inner tube, said openings through said web and inner tube generally corresponding in polygonal contour and transverse dimension, fastener plugs extending through corresponding ones of said axially aligned openings and having first and second portions of polygonal cross section respectively received in and of complementary polygonal configuration and size with the corresponding inner tube and rail openings to prevent rotation of said plugs and rung relative to said rails, each of said plugs having a retaining flange engaging the corresponding web radially outwardly of said rail opening, said first portion of each of said plugs having legs radially expandable relative to said opening through said inner tube, and means radially expanding said first portion into engagement with the inner tube of said rung.

13. The ladder according to claim 12, wherein said inner and outer tubes are generally square in cross section and said polygonal openings are generally square.

14. The ladder according to claim 13, and cover means closing the open side of each channel member.

15. The ladder according to claim 14, wherein said channel members and cover means have corresponding opposite ends, and end plate means interconnected with said cover means and extending across said ends.

16. A ladder comprising, a pair of side members of non-metallic material, said side members having walls in opposed spaced apart relationship, a plurality of rungs extending between said opposed walls, said opposed walls being apertured to provide a pair of aligned apertures corresponding to each of said rungs and each of said walls having inner and outer sides, a first metal plate member at each aperture of said pair of apertures, said first plate member having opposite ends overlying the outer side of the corresponding wall adjacent the aperture therethrough and an intermediate portion between said ends and extending through said aperture at least ot said inner side of said corresponding wall, means interengaging said ends of said first plate member with said corresponding wall against rotation relative to the axis of said aperture, a second metal plate member at each aperture of said pair of apertures said second plate member having opposite ends overlying the inner side of said corresponding wall adjacent said aperture and an intermediate portion between the latter said ends overlying said intermediate portion of said first plate member, said intermediate portions of said plate members having a non-circular opening therethrough, each of said rungs having opposite ends, each of said opposite ends of said rungs facing the intermediate portion of the second plate member at the corresponding one of said pair of apertures, said rung having a non-circular opening extending axially inwardly from each of said rung ends and axially aligned with the non-circular opening through the corresponding first and second plate members, fastener plugs extending through corresponding ones of said axially aligned non-circular openings, said plugs having first and second portions of non-circular cross section repsectively received in and interengaged with the corresponding rung and plate member openings to prevent rotation of said plugs and rung relative to said side members, each of said plugs having a retaining flange engaging the corresponding first plate member radially outwardly of the non-circular opening therethrough, said first portion of each of said plugs being radially expandable to the corresponding rung opening, and means radially expanding said first portions into engagement with said openings.

17. The ladder according to claim 16, wherein said walls of said side members include slots spaced from each aperture of said pair of apertures and said opposite ends of the corresponding first plate member include fingers integral therewith and received in said slots, said slots and fingers defining said means interengaging said ends of said first plate member with said correspodning wall.

18. The ladder according to claim 17, wherein each aperture of said pair of apertures is rectangular and said slots extend parallel to opposed sides of said aperture, said fingers having ends extending through said slots and beyond the inner side of the corresponding wall, the opposite ends of the corresponding second plate member having edges juxtaposed with respect to said ends of said fingers extending beyond said inner side.

19. The ladder according to claim 18, and detent means on said ends of said fingers, said detent means interengaging with said opposite ends of said second plate member to releasably interengage said first and second plate members with said side member.

20. The ladder according to claim 18, wherein said intermediate portion of each of said first plate members includes legs extending through the corresponding aperture adjacent said opposed sides of said aperture, said leg portions having a width corresponding to the length of said sides of said aperture.

21. The ladder according to claim 20, wherein each of said rungs is an extruded tubular metal member having concentrically interconnected inner and outer tubes, said inner tube having an inner surface square in cross section and defining said non-circular rung openings, said non-circular opening through said first and second plate members being square and dimensionally corresponding to said rung opening, and said first and second non-circular portions of said fastener plugs being square.

22. The ladder according to claim 21, wherein said side members are channel shaped in cross section and include a web defining the corresponding one of said opposed walls and flanges along opposite sides of said web and extending inwardly of said inner slides of said opposed walls.

23. The ladder according to claim 22, and detent means on said ends of said fingers, said detent means interengaging with said opposite ends of said second plate member to releaseably interengage said first and second plate members with said side member.

* * * * *